US010899583B2

(12) United States Patent
Kiuru et al.

(10) Patent No.: US 10,899,583 B2
(45) Date of Patent: Jan. 26, 2021

(54) ROPE STORAGE UNIT AND A METHOD FOR INSTALLING AN ELEVATOR ROPE

(71) Applicant: KONE Corporation, Helsinki (FI)

(72) Inventors: Antti Kiuru, Helsinki (FI); Antti Mertala, Helsinki (FI); Jani Renvall, Helsinki (FI)

(73) Assignee: KONE CORPORATION, Helsinki (FI)

( * ) Notice: Subject to any disclaimer, the term of this patent is extended or adjusted under 35 U.S.C. 154(b) by 167 days.

(21) Appl. No.: 16/277,567

(22) Filed: Feb. 15, 2019

(65) Prior Publication Data

US 2019/0177129 A1 Jun. 13, 2019

Related U.S. Application Data

(63) Continuation of application No. PCT/EP2017/070945, filed on Aug. 18, 2017.

(30) Foreign Application Priority Data

Aug. 18, 2016 (EP) ..... 16184743

(51) Int. Cl.
*B66B 19/02* (2006.01)
*B66B 7/06* (2006.01)
(Continued)

(52) U.S. Cl.
CPC ..... *B66B 19/02* (2013.01); *B65H 49/24* (2013.01); *B65H 49/322* (2013.01); *B66B 7/062* (2013.01); *B66B 7/06* (2013.01)

(58) Field of Classification Search
CPC ..... B66B 19/02; B66B 7/06; B66B 7/062; B65H 49/24; B65H 49/322
See application file for complete search history.

(56) References Cited

U.S. PATENT DOCUMENTS 6,933,441 B2 * 8/2005 Fuller ..... G02B 6/4453 174/135
9,340,395 B2 * 5/2016 Mertala ..... B66B 19/00
(Continued)

FOREIGN PATENT DOCUMENTS

EP 0959035 A2 * 11/1999 ..... B65H 75/364
EP 2 845 832 A1 3/2015
(Continued)

OTHER PUBLICATIONS

European Search Report issued in EP 16 18 4743, dated Mar. 3, 2017.

(Continued)

*Primary Examiner* — Bayan Salone
(74) *Attorney, Agent, or Firm* — Birch, Stewart, Kolasch & Birch, LLP

(57) ABSTRACT

A rope storage unit for storing an elevator rope during transportation and/or installation of the elevator rope includes a rope reel, formed by a rope wound in a spiral form and having a central axis; and a support frame provided with an inner space inside which the rope reel is positioned supported by the support frame such that it can in use be rotated in the inner space for unwinding the rope. The rope is a rod having a straight form when in rest state and elastically bendable away from the straight form, the rope being under substantial bending tension in the spiral form, and wherein the support frame comprises three or more rotatable support rollers delimiting the inner space and surrounding radially the rope reel. A method for installing an elevator rope implements the rope storage unit.

20 Claims, 7 Drawing Sheets

(51) Int. Cl.
*B65H 49/24* (2006.01)
*B65H 49/32* (2006.01)

(56) References Cited

U.S. PATENT DOCUMENTS

| | | | | |
|---|---|---|---|---|
| 2005/0103515 | A1* | 5/2005 | Fuller | G02B 6/4453 174/50 |
| 2012/0124807 | A1* | 5/2012 | Mertala | B66B 19/02 29/428 |
| 2016/0347580 | A1* | 12/2016 | Mertala | B66B 19/02 |

FOREIGN PATENT DOCUMENTS

| | | | | |
|---|---|---|---|---|
| EP | 2845832 | A1 * | 3/2015 | B65H 75/16 |
| EP | 3 034 449 | A1 | 6/2016 | |
| EP | 3034449 | A1 * | 6/2016 | B66B 19/007 |
| JP | 2002-53271 | A | 2/2002 | |
| WO | WO 2009/090299 | A1 | 7/2009 | |
| WO | WO-2009090299 | A1 * | 7/2009 | D07B 5/10 |

OTHER PUBLICATIONS

International Search Report (PCT/ISA/210) issued in PCT/EP2017/070945, dated Nov. 20, 2017.
Written Opinion of the International Searching Authority (PCT/ISA/237) issued in PCT/EP2017/070945, dated Nov. 20, 2017.

* cited by examiner

ROPE STORAGE UNIT AND A METHOD FOR INSTALLING AN ELEVATOR ROPE

FIELD OF THE INVENTION

The invention relates to storing of an elevator rope and to installing an elevator rope. The rope is, in particular, a rope for an elevator meant for transporting passengers and/or goods.

BACKGROUND OF THE INVENTION

Storing of a rope may be needed in various stages of its lifetime. The storing is conventionally implemented by forming a rope reel of the rope so that it can be stored and/or transported as a compact unit. In the field of elevators, storing is usually needed for transporting the rope to the construction site, and further to the specific installation location where the rope can be unwound and installed in the elevator. Ropes are typically irreversibly flexible such that after bending the rope into a curve, it does not reverse back to its original form. These kinds of ropes usually comprise load bearing members made of twisted wires or equivalents. This kind of rope is easy to wind around a drum where it can be stored until a later unwinding. Also such ropes exist, which are rod-like and have a straight form when in rest state. This kind of rope is presented in patent publication WO2009090299 A1, for instance. This kind of ropes are relatively rigid, but elastically bendable, and the rope self-reverses back to a straight form from bent form in rest state, i.e. after all bending directed to it ceases. A known way to store this kind of ropes has been to form a rope reel of the rope by winding it around a drum and subsequently tying the rope end against the outer rim of the rope reel so that the rope reel cannot unwind. This known method has caused difficulties in later unwinding process. In particular, after releasing the rope end, the rope end has been difficult to control. Especially, it has been found out that the bending tension is prone to cause difficulties in unwinding of the rope. The rope tends to straighten as an effect of said bending tension and may easily escape from the hands of the person preparing the unwinding operation. Avoiding this type of events has necessitated auxiliary means for controlling the rope end once it has been freed from the reel. Another solution for storing a rope of the aforementioned kind is presented in document EP2845832A1. This solution provides simple and safe control of rope end as well as the unwinding process. A drawback is that in some occasions the storage unit may use space too much. The rope needs to bend and twist slightly when exiting the rope storage unit. To avoid excessive bend and twist, one needs to dimension relatively much space for the rope passage, which may make the storage unit large. This kind of solution also requires some space axially beside the reel during the unwinding, whereby several storage units may be difficult to position compactly.

BRIEF DESCRIPTION OF THE INVENTION

The object of the invention is to introduce a new rope storage unit and a method for installing an elevator rope. An object is to introduce a solution by which one or more of the above mentioned drawbacks and/or drawbacks discussed or implied elsewhere in the description can be alleviated. An object is particularly to introduce a solution by which an elastically bendable relatively rigid rope can be stored and unwinded in a compact, simple and stabile way.

It is brought forward a new rope storage unit for storing an elevator rope during transport and/or installation of the elevator rope, comprising a rope reel, formed by a rope wound in a spiral form and having a central axis; and a support frame provided with an inner space inside which the rope reel is positioned supported by the support frame such that it can in use be rotated in the inner space for unwinding the rope, wherein the rope is a rod having a straight form when in rest state and elastically bendable away from the straight form, the rope being under substantial bending tension in said spiral form, and wherein the support frame comprises three or more rotatable support rollers delimiting said inner space and surrounding radially said rope reel. With this solution one or more of the above mentioned objects can be achieved. Preferable further details are introduced in the following, which further details can be combined with the rope storage unit individually or in any combination.

The rope is a rope for an elevator, preferably a suspension rope of an elevator car. The rope storage unit is in particular a movable storage unit so that the rope can be transported within the rope storage unit, e.g. to an installation location of an elevator. Preferably the rope storage unit is of a size and weight transportable with a fork lift.

In a preferred embodiment, said rotatable support rollers are suitable for supporting the rim of the rope reel from the outside and for rolling against it when the rope reel rotates in the inner space.

In a preferred embodiment the outer rim of the rope reel radially compresses against said support rollers as an effect of said bending tension and said rotatable support rollers block the radius thereof from expanding.

In a preferred embodiment, each of said rotatable support rollers has a central axis around which it is rotatable, which central axis extends through the rotatable support roller and is aligned parallel with the central axis of the rope reel.

In a preferred embodiment, the rotatable support rollers are positioned such that their central axes are positioned at corners of a polygon and the central axis x of the rope reel is within the polygon, particularly at the central area thereof and substantially displaced from the sides thereof.

In a preferred embodiment, each of the three or more rotatable support rollers is mounted at a fixed location on the support frame the support rollers being thereby arranged to rotate at a fixed location during unwinding.

In a preferred embodiment, the support frame comprises three, four or five four of said rotatable support rollers, most preferably four.

In a preferred embodiment, the support frame comprises two side plates, on opposite sides of the rope reel which side plates delimit the inner space in axial direction of the rope reel. Preferably, the rope reel is, at least during unwinding, freely rotatable relative to the two side face plates.

In a preferred embodiment, each said roller is freely rotatable, each said roller comprises a central axle and a sheath for contacting the rope reel, the sheath being rotatable around the central axle.

In a preferred embodiment, each said roller has outer diameter less than 20 cm.

In a preferred embodiment, the rope reel has outer diameter more than 1 meter. When the rope comprises load bearing members made of composite material, the inner diameter of the rope reel is preferably more than 50 cm.

In a preferred embodiment, each said support roller is mounted on the side plates. Then, preferably one end of the support roller is mounted on one of the side face plates and the other end of the roller on the other of the side plates.

Each support roller preferably comprises one axle end protruding through one of the side plates and another axle end protruding through the other of the side plates.

In a preferred embodiment, the two side plates comprise flanks forming a pair of support flanks for being placed to rest on top of a support base, said pair of support flanks being arranged to position the rope storage unit to stand such that the central axis of the rope reel is horizontal. For this purpose the flanks are preferably similarly shaped. The two side plates can comprise at least two such pairs of support flanks, wherein the support flanks of the different pairs are at an angle of 90 degrees from each other, whereby the storage unit can be placed in different attitudes. Said support base can be a pallet or another rope storage unit.

In a preferred embodiment said rope has width larger than thickness thereof in transverse direction of the rope, and the rope is wound in said spiral form by bending it around an axis extending in width-direction of the rope. Thus, the rope settles easily in the spiral form and formation of twist can be avoided.

In a preferred embodiment that the rope reel is formed by the rope wound in a three-dimensional spiral form. Alternatively, the rope reel could be formed by the rope wound in a two-dimensional spiral form.

In a preferred embodiment, said rope comprises one or more load bearing members extending parallel with the longitudinal direction of the rope unbroken throughout the length of the rope, which one or more load bearing members is/are made of composite material comprising reinforcing fibers in polymer matrix, said reinforcing fibers preferably being carbon fibers. This kind of structure facilitates good load supporting properties, but also requires a great force to bend the rope into spiral form, which causes a great bending tension. Thereby, the storing solution as disclosed is especially advantageous with this rope. Said reinforcing fibers are preferably carbon fibers. These fibers facilitate rope lightness and tensile stiffness, thereby making the rope well suitable for elevator use. In this case especially, a great force to bend the rope into spiral form is required. Thereby, the storing solution as disclosed is especially advantageous with this rope. The parallel and thereby straight structure increases bending rigidity even further, whereby a great force to bend the rope into spiral form is required. Thereby, the storing solution as disclosed is especially advantageous with this kind of rope.

In a preferred embodiment, the reinforcing fibers of each load bearing member are distributed in the polymer matrix of the load bearing member in question and bound together by it. The reinforcing fibers of each load bearing member are then preferably substantially evenly distributed in the polymer matrix of the load bearing member in question. Furthermore, preferably, over 50% of the cross-sectional square area of the load bearing member consists of said reinforcing fibers. Thereby, a high tensile stiffness can be facilitated. Preferably, the load bearing members cover together over proportion 50% of the cross-section of the rope.

In a preferred embodiment said reinforcing fibers are parallel with the longitudinal direction of the rope. The parallel and thereby straight structure provides a high bending rigidity, whereby a great force to bend the rope into spiral form is required. Thereby, the storing solution as disclosed is especially advantageous with this rope.

In a preferred embodiment each of said load bearing member(s) has width larger than thickness thereof as measured in width-direction of the rope.

In a preferred embodiment said one or more load bearing members is/are embedded in polymer coating, preferably elastomer coating.

In a preferred embodiment the load bearing member(s) of the rope cover(s) majority, preferably 70% or over, more preferably 75% or over, most preferably 80% or over, most preferably 85% or over, of the width of the cross-section of the rope. In this way at least majority of the width of the rope will be effectively utilized and the rope can be formed to be light and thin in the bending direction for reducing the bending resistance.

In a preferred embodiment the module of elasticity (E) of the polymer matrix is over 2 GPa, most preferably over 2.5 GPa, yet more preferably in the range 2.5-10 GPa, most preferably of all in the range 2.5-3.5 GPa. In this way a structure is achieved wherein the matrix essentially supports the reinforcing fibers, in particular from buckling. This structure also increases stiffness of the rope in bending.

In a preferred embodiment, the rope reel has an end section of said rope placed against or protruding from the outer rim of the rope reel, and the rope is unwindable by rotating or allowing rotation of the rope reel in the inner space and guiding said end away from the rope reel.

In a preferred embodiment, the frame either comprises or it is provided for being dismantled to comprise an opening at the radial side of the rope reel leading out from the inner space, via which opening said end section can be guided away from the rope reel.

In a preferred embodiment, the rope is wound in a spiral form with several rope rounds, including at least an outermost rope round having an outer rim radially compressing against said support rollers as an effect of said bending tension, as well as several inner rope rounds each having an outer rim radially compressing, as an effect of said bending tension, against the inner rim of the rope round next in radial direction.

In a preferred embodiment, the rope is wound in a spiral form with several rope rounds, including at least a radially outermost rope round, and a radially innermost rope round, the rope being unwindable rope round by rope round starting from the outermost rope round.

In a preferred embodiment, the rope is wound in a spiral form with several rope rounds, intermediate rope rounds between the innermost and outermost rope rounds, the intermediate rounds radially compressing against the round next in radial direction (outwards) of the rope reel as an effect of said bending tension.

In a preferred embodiment, the side plate is made of wood-based plate material, most preferably fiberboard or plywood.

In a preferred embodiment, the support frame preferably additionally comprises a protective drum around the inner space.

In a preferred embodiment, the storage unit comprises components inside the central space of the rope reel, which rotate together with the rope reel when this is rotated during unwinding. Such components may include an inner support drum, which can form a base on which the rope is wound when fabricating the storage unit and/or when winding an old rope away from an elevator system during rope changing. The inner support drum can be provided with manually operable rotating means for manually rotating the drum.

In a preferred embodiment, the rope storage unit comprises a further support arrangement for carrying at least part of the weight of the rope reel from the inside, i.e. from the direction of the central space thereof. The further support arrangement is advantageous because when the rope storage unit is delivered to an installation site by various kind of transportation methods, the rope storage unit may face several liftings, drops and vibration. The further support arrangement facilitates that the rotatable support rollers and the side plates are less likely to deform generally due to weight of the rope reel or due to impacts or vibration of the delivery. The deformed parts or surfaces would cause non-rotation of the rope reel during rope installation, which will lay dangers for the work. Also, if the inner reel is not secured, the impact from the drop down could damage the bottommost rollers and the rolling surfaces. Preferably, said further support arrangement can be dismantled before unwinding the rope from the rope storage unit. Preferably, said further support arrangement comprises a support member extending inside the central space of the rope reel. Preferably, the rope reel rests (with at least part of its weight) on the support member extending inside the central space of the rope reel. This can be implemented such that said support member is supported on the side plates of the support frame, for example. The support member is preferably an elongated bar, the bar preferably being a wooden bar, such as one with standard size cross section of 2×4 inches, for example.

In a preferred embodiment, the aforementioned support arrangement comprises support plates mounted on the side plates, and the rope reel extends between the support plates. The elongated bar preferably extends through an opening formed in each of said support plates.

It is also brought forward a new method for installing an elevator rope, comprising the steps of providing a rope storage unit as defined anywhere above or elsewhere in the application, such as in the claims; and unwinding the rope from the rope storage unit; and connecting the rope to one or more movable elevator units, said units, including at least an elevator car and preferably also a counterweight. With this solution one or more of the above mentioned objects can be achieved. Preferable further details are introduced in the following, which further details can be combined with the method individually or in any combination.

In a preferred embodiment, the rope is wound in a spiral form with several rope rounds, including at least an radially outermost rope round, and an radially innermost rope round, and in said unwinding the rope is unwound rope round by rope round starting from the outermost rope round.

In a preferred embodiment, said unwinding comprises rotating or allowing rotation of the rope reel in the inner space such that said rotatable support rollers support the rim of the rope reel from the outside, and roll against it.

In a preferred embodiment, the rope wound in a spiral form has an end section of said rope placed against or protruding from the outer rim of the rope reel, and said unwinding comprises rotating or allowing rotation of the rope reel in the inner space and guiding said end section away from the rope reel.

In a preferred embodiment, the frame either comprises or it is dismantled to comprise an opening at the radial side of the rope reel leading out from the inner space, via which opening said end section is be guided away from the rope reel in said unwinding.

In a preferred embodiment, the support frame is arranged to be immovable relative to the mounting base of the rope storage unit during said unwinding.

In a preferred embodiment, at least part of the weight of the rope reel is carried by one or more of the aforementioned rotatable support rollers at least during said unwinding the rope from the rope storage unit.

In a preferred embodiment, at least part of the weight of the rope reel is carried by a further support arrangement from the inside at least prior said unwinding. Preferably, this is the case at least during the transport of the rope storage unit, which transport precedes the unwinding.

In a preferred embodiment, before said unwinding the rope from the rope storage unit, the further support arrangement is dismantled. The dismantling step then preferably comprises shifting (more of) the weight of the rope reel to be carried by one or more of the rotatable support rollers.

The elevator is preferably such that the car thereof is configured to serve two or more vertically displaced landings. The elevator is preferably configured to control movement of the car in response to signals from user interfaces located at landing(s) and/or inside the car so as to serve persons on the landing(s) and/or inside the elevator car. Preferably, the car has an interior space suitable for receiving a passenger or passengers or goods, and the car can be provided with a door for forming a closed interior space.

BRIEF DESCRIPTION OF THE DRAWINGS

In the following, the present invention will be described in more detail by way of example and with reference to the attached drawings, in which.

The foregoing aspects, features and advantages of the invention will be apparent from the drawings and the detailed description related thereto.

DETAILED DESCRIPTION

Figure 1:
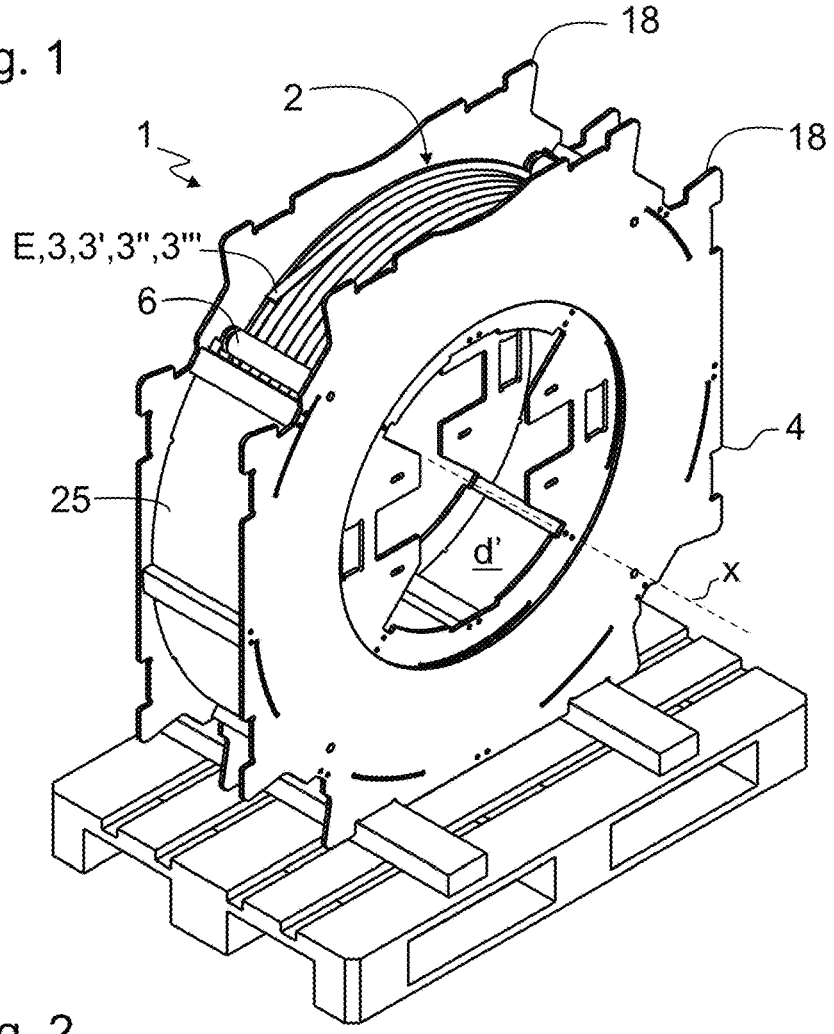
FIG. 1 illustrates a three dimensional view of the rope storage unit according to an embodiment.
Figure 2:
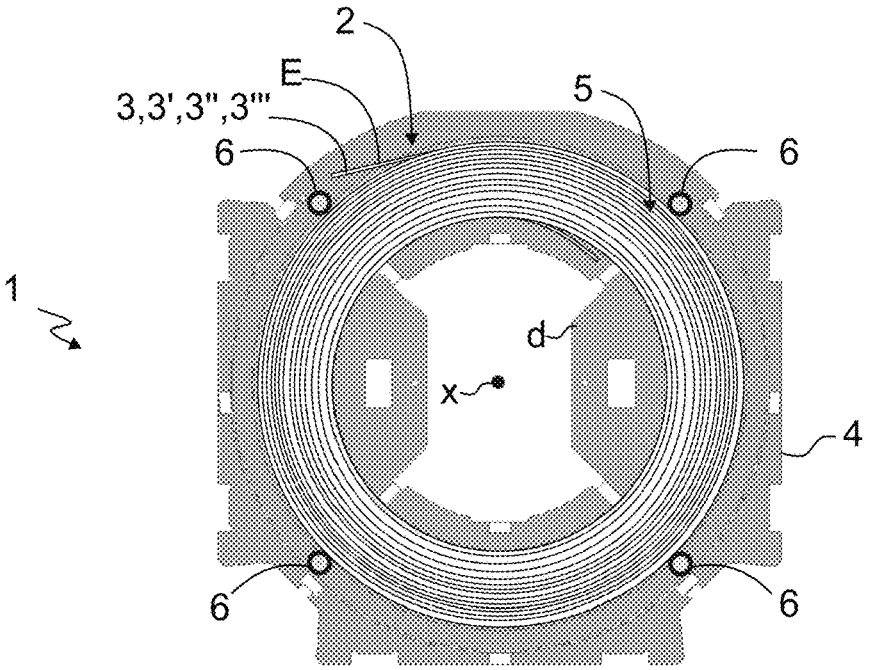
FIG. 2 illustrates a cross sectional view of the rope storage unit of FIG. 1 as viewed in axial direction of the rope reel.

FIGS. 1 and 2 illustrates an embodiment of a rope storage unit 1 for storing an elevator rope. The rope storage unit 1 comprises a rope reel 2, formed by a rope 3,3',3",3'" wound in a spiral form and having a central axis x; and a support frame 4 provided with an inner space 5 inside which the rope reel 2 is positioned supported by the support frame 4 such that it can in use be rotated in the inner space 5 for unwinding the rope 3,3',3",3'". The rope 3,3',3",3'" has two ends, and thereby a first end section and a second end section. The rope 3,3',3",3'" is a rod having a straight form when in rest state i.e. in a state where no external force is exerted on the rope 3,3',3",3'", and elastically bendable away from the straight form. Thereby, it self-reverses to straight form from bent form. For this reason, the rope 3,3',3",3'" is under substantial bending tension in said spiral form.

The support frame 4 comprises three or more rotatable support rollers 6 delimiting said inner space 5 and surrounding radially said rope reel 2. Said rotatable support rollers 6 are suitable for and arranged to support the rim of the rope reel 2 from the outside and to roll against it when the rope reel 2 rotates in the inner space 5. The outer rim of the rope reel 2, more specifically the rope thereof, compresses in radial direction of the rope reel 2 against said support rollers 6, in particular their rims, as an effect of said bending tension and said rotatable support rollers 6 block the radius thereof from expanding. Thereby said support rollers 6 block the rope of the rope reel 2 from straightening as well as mount the rope reel 2 rotatably on the support frame 4.

The storage unit 1 can comprise components d inside the central space of the rope reel 2, which rotate together with the rope reel 2 when this is rotated during unwinding. Such components may include an inner support drum d', which can form a base on which the rope 3,3',3",3'" is wound when fabricating the storage unit 1 and/or when winding an old rope away from an elevator system during rope changing. The rope being prone to expand and the support rollers being able to support its outer rim, components d are not necessary within the rope reel 2.

Each of said rotatable support rollers 6 has a central axis x2 around which it is rotatable, which central axis x2 extends through the rotatable support roller in question and is aligned parallel with the central axis x of the rope reel 2. Three rollers 6 is the minimum for enabling that the rope reel 2 is supported such that the radius cannot expand. In the embodiment as illustrated in FIG. 1 the support frame 4 comprises four support rollers 6, which is preferable to ensure that the radius of the rope reel 2 cannot expand with small amount of components.

As illustrated in FIGS. 1 and 2, the rope 3,3',3",3'" is wound in a spiral form with several rope rounds, including at least an outermost rope round having an outer rim, and forming at least part of the aforementioned outer rim of the rope reel, radially compressing against said support rollers 6 as an effect of said bending tension, as well as several inner rope rounds each having an outer rim radially compressing, as an effect of said bending tension, against the inner rim of the rope round next to it in radial direction.

In the illustrated example, the rope reel 2 is formed by the rope 3,3',3",3'" wound in a three-dimensional spiral form whereby the rope rounds are not all on a same plane and the rope rounds pass in a slight angle relative to radial plane of the rope reel oscillating back and forth in axial direction as it is commonly known in the field of winding of rope reels or corresponding reels. Alternatively, the rope reel 2 could be formed by the rope 3,3',3",3'" wound in a two-dimensional spiral form, in which case substantially all the rope rounds are on a same plane, for instance.

The rope reel 2 has an end section E placed against or protruding from the outer rim of the rope reel 2, and the rope 3,3',3",3'" is unwindable by rotating or allowing rotation of the rope reel 2 in the inner space and guiding said end section E away from the rope reel 2. The rope 3,3',3",3'" is thereby unwindable rope round by rope round starting from the outermost rope round. During unwinding, each round of the rope 3,3',3",3'" still unwound and remaining on the rope reel 2 stays tensioned against the next outer round, the outermost round staying tensioned against said rollers 6. Thereby, self-progressing of the unwinding can be avoided and the unwinding process can be kept easily under control. Thereby, also safety is improved. The rope 3,3',3",3'" is unwindable in substantially tangential direction from the rope reel 2, whereby it can be ensured that it does not experience excessive twist or bend. The rollers 6 facilitate unobstructed rotation the rope reel 2 within the inner space 5 as the rollers 6 roll against the rim of the rope reel 2.

The frame 4 comprises two side plates 18 relative to which the rope reel 2 is arranged to be freely rotatable in use. The side plates 18 can be made of wood-based plate material, most preferably fiberboard or plywood, for instance. Each of the three or more rotatable support rollers 6 is mounted at a fixed location on the support frame 4 the support rollers being thereby arranged to rotate at a fixed location during unwinding. For this purpose, the support rollers 6 are mounted on the side plates 18 such that they are stationary when the rope reel 2 rotates.

Figure 5:
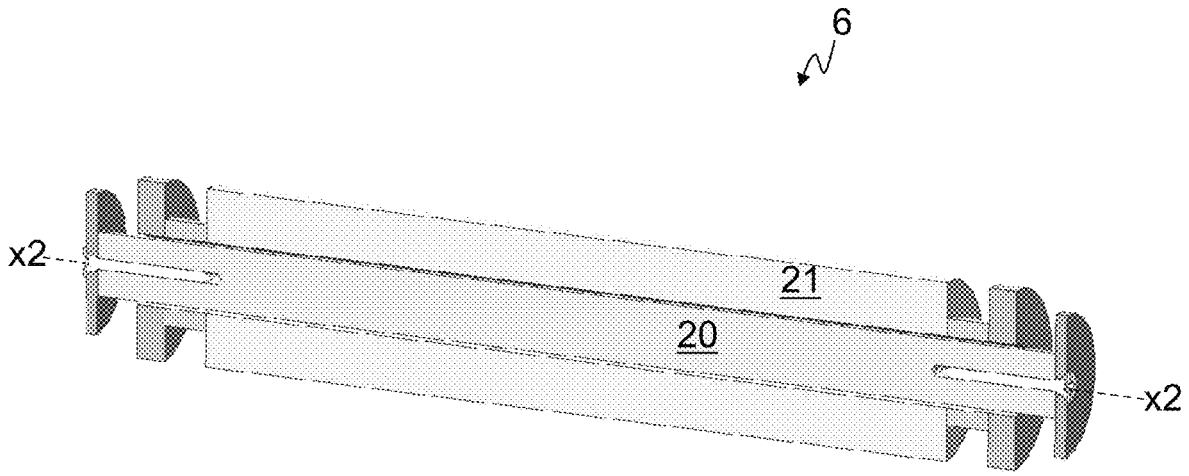
FIG. 5 illustrates a cross-sectional view of a preferred structure for a support roller of the rope storage unit of FIG. 1.
Figure 6:
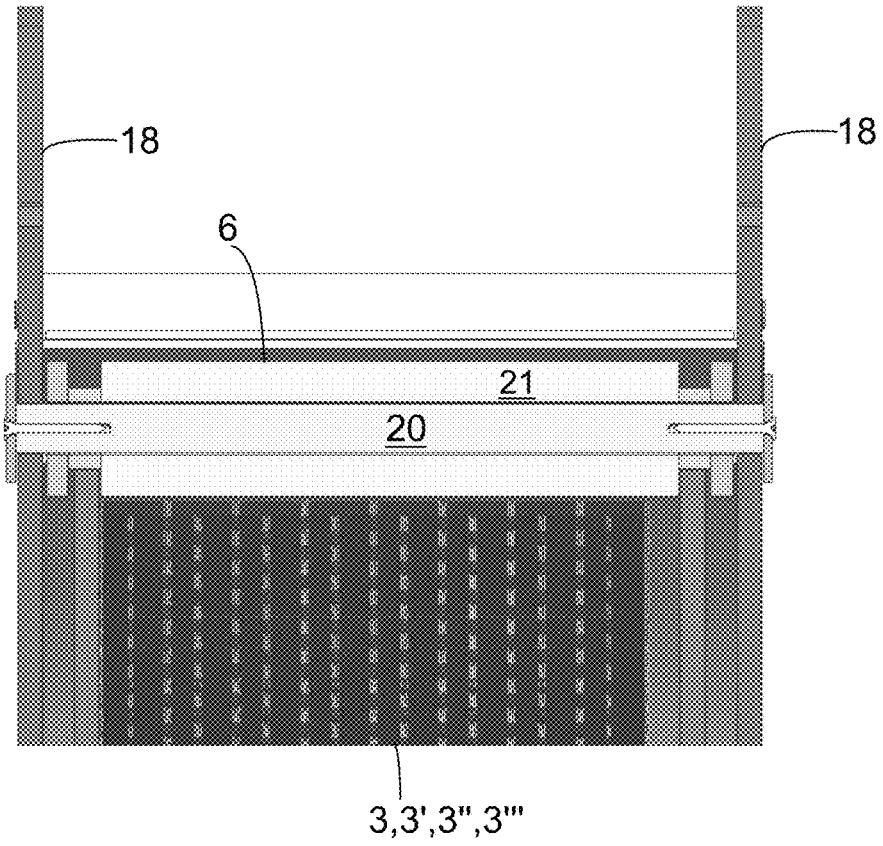
FIG. 6 illustrates a partial radial view of preferred further details of mounting of support rollers of FIG. 5.

FIG. 5 illustrates a preferred structure for the support roller 6 and FIG. 6 illustrates a preferred structure for mounting of the support roller 6. The roller 6 is freely rotatable, each said roller comprises a central axle 20 and a sheath 21 for contacting the rope reel, the sheath being rotatable around the central axle 20. The support frame 4 comprises two side plates 18, on opposite sides of the rope reel 2 which side plates 18 delimit the inner space 5 in axial direction of the rope reel 2. Each said roller is mounted on the side plates. One end of the roller is mounted on one of the side face plates 18 and the other end of the roller on the other of the side plates 18. Each roller 6 comprises one axle end protruding through one of the side face plates 18 and another axle end protruding through the other of the side plates 18.

The two side plates 18 comprise flanks 22 forming a pair of support flanks for being placed to rest on top of a support base, said pair of support flanks being arranged to position the rope storage unit to stand such that the central axis x of the rope reel 2 is horizontal. For this purpose the flanks 22 are similarly shaped. It is preferable, as illustrated, that the two side plates 18 comprise at least two such pairs of support flanks, wherein the support flanks of the different pairs are at an angle of 90 degrees from each other, whereby the storage unit 1 can be placed in different attitudes. Said support base can be a pallet or another rope storage unit. Plurality of rope storage units 1 as disclosed can be placed beside each other and/or on top of each other. This facilitates their space efficient placement during installation and/or during transport.

Figure 8:
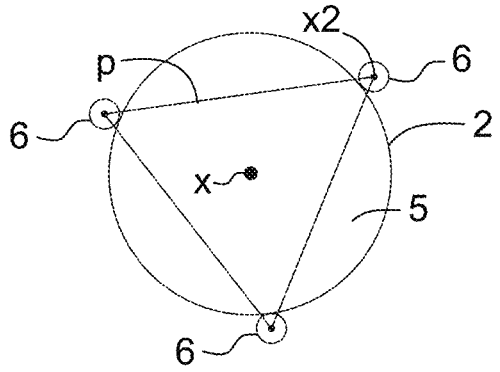
FIGS. 8-10 illustrate preferred alternatives for the number and positioning of the support rollers.
Figure 9:
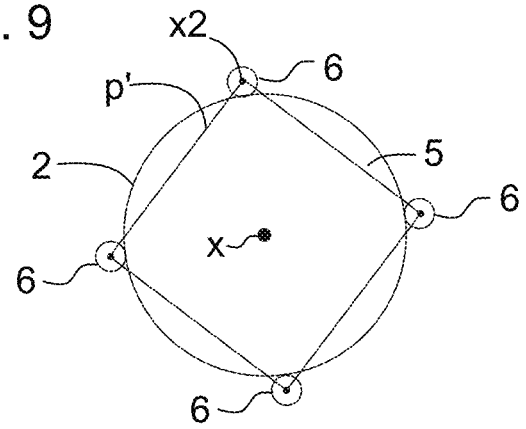
Figure 10:
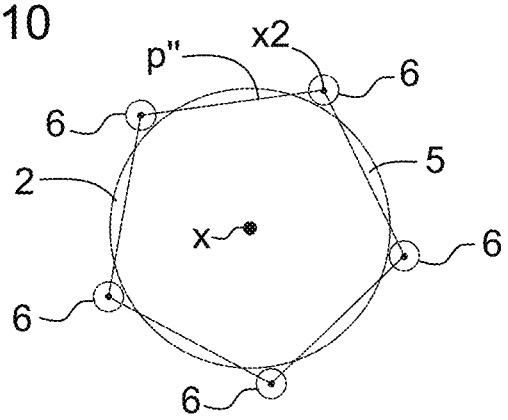

FIGS. 8-10 illustrate alternative configurations for the number and positioning of the support rollers 6 relative to the rope reel 2. In each case, the rotatable support rollers 6 are positioned such that their central axes are positioned at corners of a polygon p and the central axis x of the rope reel 2 is within the polygon p, at the central area thereof and substantially displaced from the sides thereof. Thus, the support rollers 6 are positioned to surround the rope reel 2 such that it cannot be displaced from the inner space 5. In configuration of FIG. 8, the polygon is a triangle, and the number of said support rollers is three. In configuration of FIG. 9, the polygon is a quadrangle, and the number of said support rollers is four. In configuration of FIG. 10, the polygon is a pentagon, and the number of said support rollers is five.

The support frame 4 preferably additionally comprises a protective drum 25 around the inner space 5. The protective drum 25 can be made of one or more fiberboard members bent into curved shape. The protective drum 25 protect the rope 3,3',3",3'" e.g. during transport of the rope reel 2 and/or during installation. During installation, the protective drum 25 can be at least partially dismantled to form an opening at the radial side of the rope reel 2 leading out from the inner space through which the rope 3,3',3",3''' can be guided away from the rope reel 2, or alternatively the protective protective drum 25 can comprise such an opening.

As mentioned, the rope 3,3',3",3''' is a rod having a straight form when in rest state. Such a rod can be obtained with alternative cross-sections. FIGS. 11*a* to 11*d* present preferred alternatives for the cross section of the rope 3,3',3",3'''. The rope 3,3',3",3''' is preferably a belt-like rope, as illustrated. That is, the rope 3,3',3",3''' has width larger than thickness thereof in transverse direction of the rope 3,3',3",3'''. Thereby, the rope suits well to be stored in bent form as the radius of the rope storage unit can be made reasonable even with very rigid ropes. Then, the rope 3,3',3",3''' is wound in said spiral form by bending it around an axis extending in width-direction of the rope 3,3',3",3'''. Thus, the rope 3,3',3",3''' settles easily in the spiral form, without excessive use of force and substantially completely without twist, which are preferable when the rope contains parts made of fragile material such as composite material.

Preferred alternatives for the cross section of the rope 3,3',3",3''' are presented in FIGS. 11*a* to 11*d*. In these alternatives, the rope 3,3',3",3''' comprises one or more load bearing members 8, 8', 8", 8''' that are each elongated in the longitudinal direction of the rope 3,3',3",3''' and extend parallel with the longitudinal direction of the rope unbroken throughout the length of the rope 3,3',3",3'''.

Figure 11:
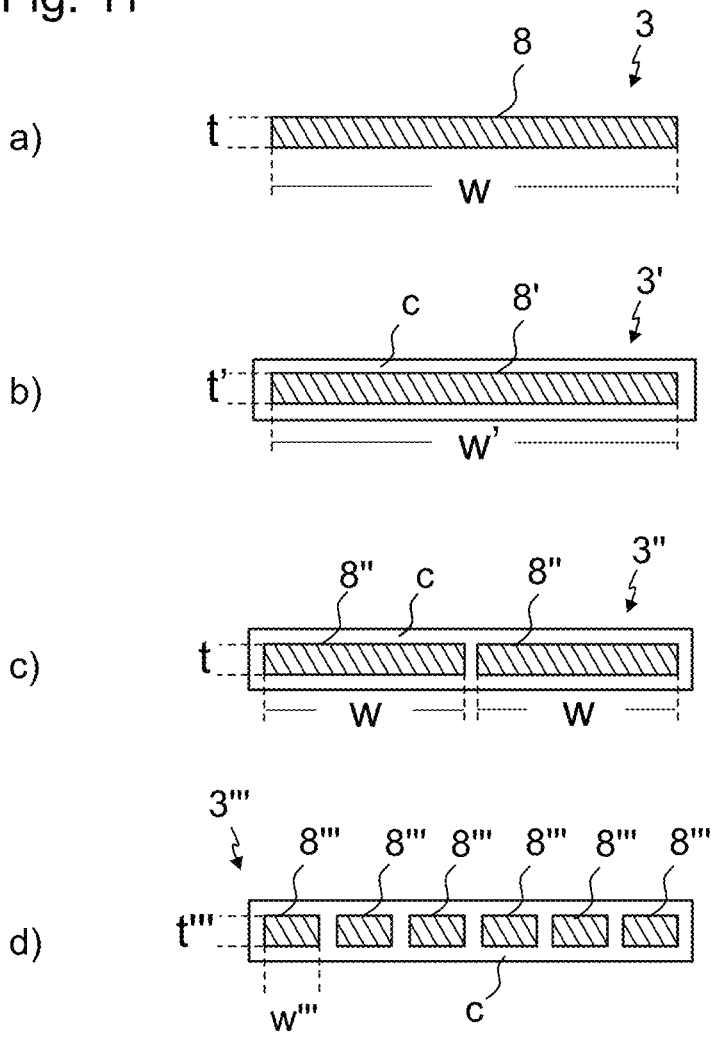
FIG. 11 illustrates a preferred alternatives for the cross section of the rope.

The alternatives disclosed in FIG. 11 are as follows. Each rope 3, 3' as illustrated in FIGS. 11*a* and 11*b* comprises only one load bearing member 8,8'. Each rope 3",3''' as illustrated in FIGS. 11*c* and 11*d* comprises a plurality of load bearing members 8",8'''. The load bearing members 8",8''' are adjacent in width-direction of the rope 3",3'''. They are parallel with the longitudinal direction of the rope and coplanarly positioned. Thus the resistance to bending in their thickness direction can be maintained reasonable.

Figure 3:
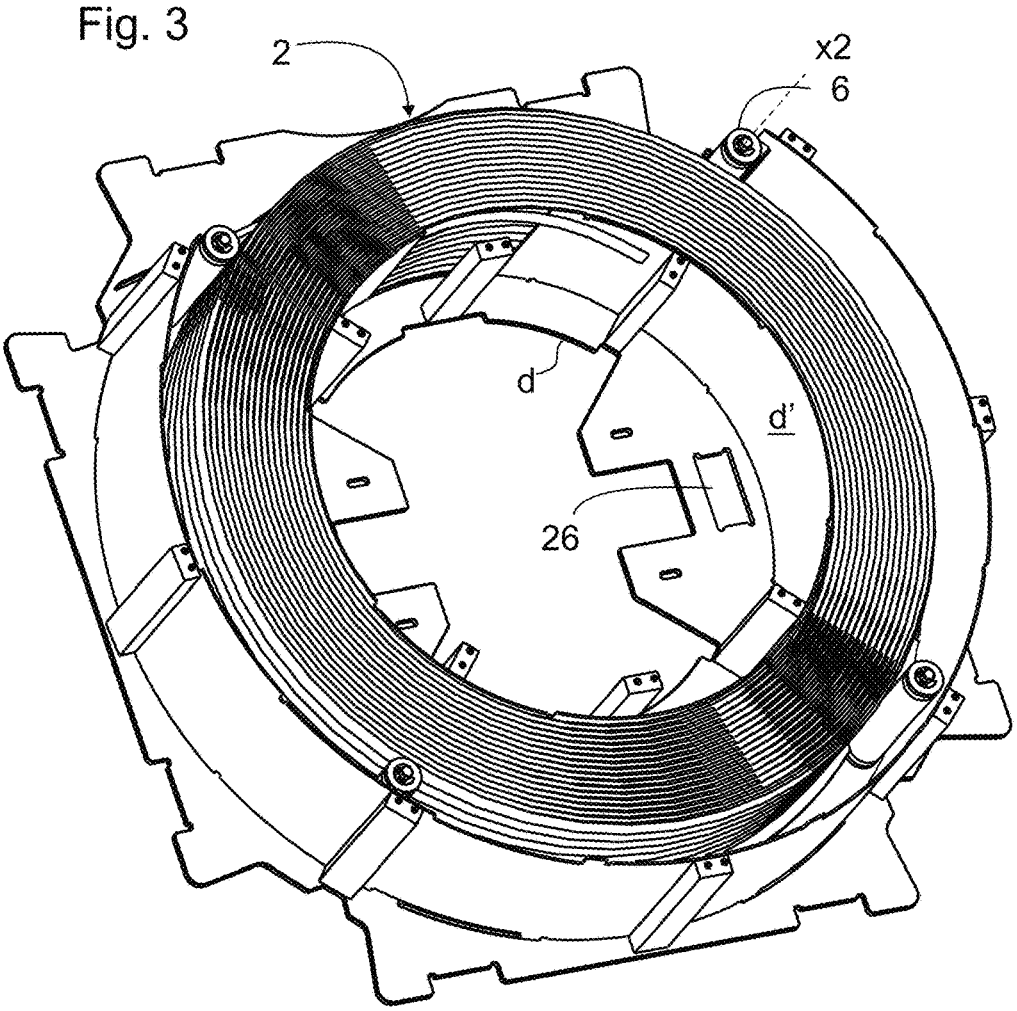
FIG. 3 illustrates a partial three dimensional view of the rope storage unit.
Figure 4:
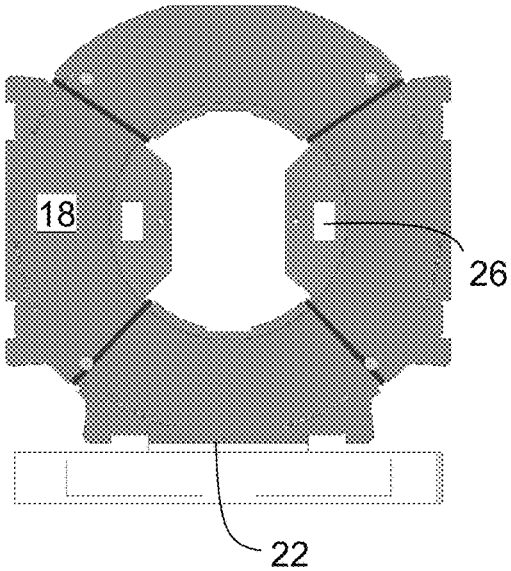
FIG. 4 illustrates the rope storage unit with additional packing straps and mounted on a fork lift pallet.

The load bearing member 8 can be without a polymer coating c as presented in FIG. 11*a*. Thereby, the load bearing member may form as such the rope 3. The load bearing members 8',8",8" of each rope presented in FIGS. 3*b* to 3*d* is/are surrounded with a coating c in which the load bearing members 8',8",8" are embedded. It provides the surface for contacting a drive wheel of the elevator, for instance. Coating c is preferably made of polymer, most preferably of an elastomer, most preferably polyurethane, and forms the surface of the rope 3',3",3'''. It enhances effectively the ropes frictional engagement to the drive wheel 3 and protects the rope. For facilitating the formation of the load bearing member 8, 8', 8", 8''' and for achieving constant properties in the longitudinal direction it is preferred that the structure of the load bearing member 8, 8', 8", 8''' continues essentially the same for the whole length of the rope 3,3',3",3'''.

As mentioned, the rope 3,3',3",3''' is belt-shaped. The width/thickness ratio of the rope is preferably at least at least 4, more preferably at least 5 or more, even more preferably at least 6, even more preferably at least 7 or more, yet even more preferably at least 8 or more. In this way a large cross-sectional area for the rope is achieved, the bending capacity around the width-directional axis being good also with rigid materials of the load bearing member. Thereby the rope suits well to be positioned in the rope storage unit 1 in bent form, as well as to the use of suspending an elevator car.

The rope 3,3',3",3''' is preferably furthermore such that the aforementioned load bearing member 8 or a plurality of load bearing members 8', 8", 8''', comprised in the rope 3,3',3",3''', together cover majority, preferably 70% or over, more preferably 75% or over, most preferably 80% or over, most preferably 85% or over, of the width of the cross-section of the rope 3,3',3",3''' for essentially the whole length of the rope 3,3',3",3'''. Thus the supporting capacity of the rope with respect to its total lateral dimensions is good, and the rope does not need to be formed to be thick. This can be simply implemented with the composite as specified elsewhere in the application and this is particularly advantageous from the standpoint of, among other things, service life and bending rigidity in elevator use. The width of the rope 3,3',3",3''' is thus also minimized by utilizing their width efficiently with wide load bearing member and using composite material. Individual belt-like ropes and the bundle they form can in this way be formed compact.

As for its materials, the rope 3,3',3",3''' is furthermore preferably such that the load bearing members 8, 8', 8", 8''' thereof are made of composite material comprising reinforcing fibers f in polymer matrix m. This kind of material provides that the rope is elastically bendable away from the straight form and, when wound in spiral form, under substantial bending tension. Preferably, the reinforcing fibers f are carbon fibers. Thus a light rope with high tensile stiffness can be obtained. Being elastically bendable away from the straight form means the rope 3,3',3",3''' self-reverses to straight form from bent form. It is rigid in bending and therefore the advantageous rope storage unit 1 of the disclosed kind is provided to store this rope to facilitate safe and controlled transport and/or installation. Also, using other reinforcing fibers as fibers f of the composite material, such as glass fiber, can provide these properties for the rope 3,3',3",3'''. Said reinforcing fibers are preferably also parallel with the longitudinal direction of the rope so the tensile stiffness can be maximized. It is preferable, that each of said load bearing member(s) 8, 8', 8", 8''' has width w,w',w",w''' larger than thickness t,t',t",t''' thereof as measured in transverse direction of the rope 3,3',3",3'''. In this way a large cross-sectional area for the load bearing member/parts 3,3', 3",3''' is achieved, without weakening the bending capacity around an axis extending in the width (extending from left to right in FIG. 11) direction of the rope 3,3',3",3'''. A small number of wide load bearing members comprised in the rope 3,3',3",3''' leads to efficient utilization of the width of the rope 3,3',3",3''', thus making it possible to keep the rope width within advantageous limits.

Figure 12:
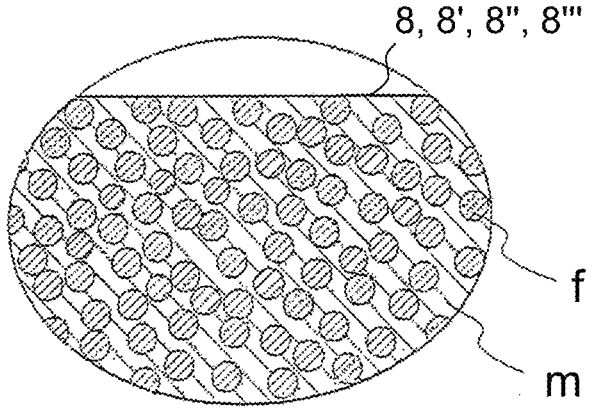
FIG. 12 illustrates a preferred internal structure for the load bearing member.

The inner structure of the load bearing member 8, 8',8",8''' is more specifically as illustrated in FIG. 12 and described in the following. The load bearing member 8, 8',8",8''' with its fibers f oriented in longitudinal direction of the rope, i.e. parallel with the longitudinal direction of the rope 3,3',3",3'''. Individual fibers are thus oriented in the longitudinal direction of the rope. In this case the fibers f are aligned with the force when the rope is pulled in its longitudinal direction. Individual reinforcing fibers f are bound into a uniform load bearing member with the polymer matrix m in which they are embedded. Thus, each load bearing member 8, 8',8",8''' is one solid elongated rod like piece. The reinforcing fibers f are preferably long continuous fibers in the longitudinal direction of the rope 3,3',3",3''' and the fibers f preferably continue for the distance of the whole length of the rope 3,3',3",3'''. Preferably as many fibers f as possible, most preferably essentially all the fibers f of the load bearing member 8, 8',8",8''' are oriented in longitudinal direction of the rope. The reinforcing fibers f are in this case essentially untwisted in relation to each other. Thus the structure of the load bearing member can be made to continue the same as far as possible in terms of its cross-section for the whole length of the rope. The reinforcing fibers f are preferably distributed in the aforementioned load bearing member 8, 8',8",8'" as evenly as possible, so that the load bearing member 8, 8',8",8'" would be as homogeneous as possible in the transverse direction of the rope. An advantage of the structure presented is that the matrix m surrounding the reinforcing fibers f keeps the interpositioning of the reinforcing fibers f essentially unchanged. It equalizes with its slight elasticity the distribution of a force exerted on the fibers, reduces fiber-fiber contacts and internal wear of the rope, thus improving the service life of the rope. The reinforcing fibers being carbon fibers, a good tensile rigidity and a light structure and good thermal properties, among other things, are achieved. They possess good strength properties and rigidity properties with small cross sectional area, thus facilitating space efficiency of a roping with certain strength or rigidity requirements. They also tolerate high temperatures, thus reducing risk of ignition. Good thermal conductivity also assists the onward transfer of heat due to friction, among other things, and thus reduces the accumulation of heat in the parts of the rope. The composite matrix m, into which the individual fibers f are distributed as evenly as possible, is most preferably of epoxy resin, which has good adhesiveness to the reinforcements and which is strong to behave advantageously with carbon fiber. Alternatively, e.g. polyester or vinyl ester can be used. Alternatively some other materials could be used. FIG. 12 presents a partial cross-section of the surface structure of the load bearing member 8, 8',8",8'" as viewed in the longitudinal direction of the rope, presented inside the circle in the figure, according to which cross-section the reinforcing fibers f of the load bearing members 8, 8',8",8'" are preferably organized in the polymer matrix m. FIG. 12 presents how the individual reinforcing fibers f are essentially evenly distributed in the polymer matrix m, which surrounds the fibers and which is fixed to the fibers f. The polymer matrix m fills the areas between individual reinforcing fibers f and binds essentially all the reinforcing fibers f that are inside the matrix m to each other as a uniform solid substance. In this case abrasive movement between the reinforcing fibers f and abrasive movement between the reinforcing fibers f and the matrix m are essentially prevented. A chemical bond exists between, preferably all, the individual reinforcing fibers f and the matrix m, one advantage of which is uniformity of the structure, among other things. To strengthen the chemical bond, there can be, but not necessarily, a coating (not presented) of the actual fibers between the reinforcing fibers and the polymer matrix m. The polymer matrix m is of the kind described elsewhere in this application and can thus comprise additives for fine-tuning the properties of the matrix as an addition to the base polymer. The polymer matrix m is preferably of a hard non-elastomer. The reinforcing fibers f being in the polymer matrix means here that in the invention the individual reinforcing fibers are bound to each other with a polymer matrix m e.g. in the manufacturing phase by immersing them together in the molten material of the polymer matrix. In this case the gaps of individual reinforcing fibers bound to each other with the polymer matrix comprise the polymer of the matrix. In this way a great number of reinforcing fibers bound to each other in the longitudinal direction of the rope are distributed in the polymer matrix. The reinforcing fibers are preferably distributed essentially evenly in the polymer matrix such that the load bearing member is as homogeneous as possible when viewed in the direction of the cross-section of the rope. In other words, the fiber density in the cross-section of the load bearing member does not therefore vary greatly. The reinforcing fibers f together with the matrix m form a uniform load bearing member, inside which abrasive relative movement does not occur when the rope is bent. The individual reinforcing fibers of the load bearing member 8, 8',8",8'" are mainly surrounded with polymer matrix m, but fiber-fiber contacts can occur in places because controlling the position of the fibers in relation to each other in their simultaneous impregnation with polymer is difficult, and on the other hand, perfect elimination of random fiber-fiber contacts is not necessary from the viewpoint of the functioning of the invention. If, however, it is desired to reduce their random occurrence, the individual reinforcing fibers f can be pre-coated such that a polymer coating is around them already before the binding of individual reinforcing fibers to each other. In the invention the individual reinforcing fibers of the load bearing member can comprise material of the polymer matrix around them such that the polymer matrix m is immediately against the reinforcing fiber but alternatively a thin coating, e.g. a primer arranged on the surface of the reinforcing fiber in the manufacturing phase to improve chemical adhesion to the matrix m material, can be in between. Individual reinforcing fibers are distributed evenly in the load bearing member 8, 8',8",8'" such that the gaps of individual reinforcing fibers f are filled with the polymer of the matrix m. Most preferably the majority, preferably essentially all of the gaps of the individual reinforcing fibers fin the load bearing member are filled with the polymer of the matrix m. The matrix m of the load bearing member 8, 8',8",8'" is most preferably hard in its material properties. A hard matrix m helps to support the reinforcing fibers f, especially when the rope bends, preventing buckling of the reinforcing fibers f of the bent rope, because the hard material supports the fibers f. To reduce the buckling and to facilitate a small bending radius of the rope, among other things, it is therefore preferred that the polymer matrix m is hard, and therefore preferably something other than an elastomer (an example of an elastomer: rubber) or something else that behaves very elastically or gives way. The most preferred materials are epoxy resin, polyester, phenolic plastic or vinyl ester. The polymer matrix m is preferably so hard that its module of elasticity (E) is over 2 GPa, most preferably over 2.5 GPa. In this case the module of elasticity (E) is preferably in the range 2.5-10 GPa, most preferably in the range 2.5-3.5 GPa. Preferably over 50% of the surface area of the cross-section of the load bearing member is of the aforementioned reinforcing fiber, preferably such that 50%-80% is of the aforementioned reinforcing fiber, more preferably such that 55%-70% is of the aforementioned reinforcing fiber, and essentially all the remaining surface area is of polymer matrix m. Most preferably such that approx. 60% of the surface area is of reinforcing fiber and approx. 40% is of matrix m material (preferably epoxy). In this way a good longitudinal strength of the rope is achieved.

Figure 7:
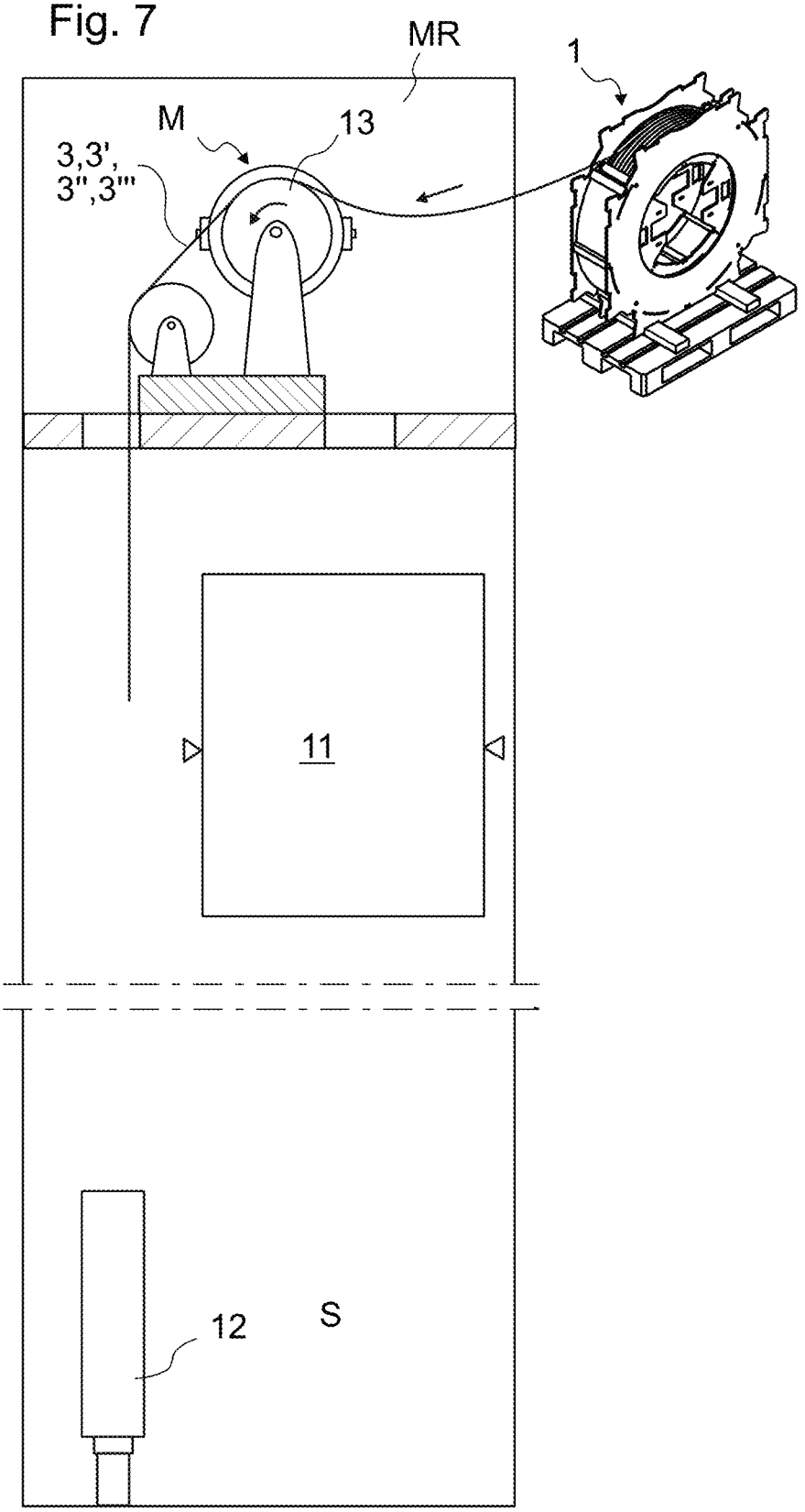
FIG. 7 illustrates details of the arrangement whereby an installation method is implemented.

FIG. 7 illustrates a method for installing an elevator rope 3,3',3",3'" according to a preferred embodiment. In the method one or more rope storage units 1 are provided. A rope 3,3',3",3'" is unwound from each rope storage unit 1 as illustrated in FIG. 7, and connected to movable elevator units 11,12, i.e. to an elevator car 11 and a counterweight 12, to suspend these. In the preferred embodiment, a first end section of the rope 3,3',3",3'" is connected to the car 11 and the second end section to the counterweight 12. In the method, a plurality of ropes 3,3',3",3'" are preferably installed in this way simultaneously. The elevator comprises a hoistway S, an elevator car 1 and a counterweight 2 installed with the method to be vertically movable in the hoistway S. The elevator further includes a drive machine M which is installed with the method to drive the elevator car 1 under control of an elevator control system (not shown). During said unwinding the rope 3,3',3",3'" is guided to pass over a drive wheel 13 of the drive machine M. The drive machine M is in this embodiment mounted inside a machine room MR, but the elevator could alternatively have a machine roomless configuration. The drive wheel 13 is arranged to engage said ropes 3,3',3",3'" passing over the drive wheel 13 and suspending the elevator car 11 and the counterweight 12. Thus, driving force can be transmitted from the motor to the car 11 and counterweight 12 via the drive wheel 13 and the ropes 3,3',3",3'" so as to move the car 11 and counterweight 12.

As elsewhere explained, the rope 3,3',3",3'" is wound in a spiral form with several rope rounds, including at least an radially outermost rope round, and an radially innermost rope round. In said unwinding the rope is unwound round by rope round starting from the outermost rope round. The rope 3,3',3",3'" wound in a spiral form has an end E placed against or protruding from the outer rim of the rope reel 2, and said unwinding comprises rotating or allowing rotation of the rope reel in the inner space and guiding said end section E away from the rope reel 2. Said unwinding comprises rotating or allowing rotation of the rope reel in the inner space such that said rotatable support rollers 6 support the rim of the rope reel 2 from the outside and roll against it. The frame either comprises or it is dismantled to comprises an opening at the radial side of the rope reel leading out from the inner space, via which opening said end section E is guided away from the rope reel 2. The support frame 4 is immovably relative to the mounting base of the rope storage unit during the unwinding.

The elevator car 11 and the counterweight may be at any suitable position during said unwinding. However, when the connecting of the rope 3,3',3",3'" to the car is performed, preferably the car is at an upper end of the hoistway S and the counterweight resting on its buffer at the lower end of the hoistway S so as to fit their positions to suit the rope length.

The belt-like ropes as illustrated, have smooth surfaces. However, the ropes could be formed to have a contoured outer surface such as polyvee shapes or teeth. Even though the embodiments are most advantageous with belt-like ropes, many of the advantages would be achieved with ropes having a round cross section as well.

In this application, the term load bearing member refers to the part that is elongated in the longitudinal direction of the rope extending unbroken throughout the length of the rope. The part is able to bear without breaking tensile load exerted on the rope in question in the longitudinal direction of the rope. The tensile load can be transmitted inside the load bearing member all the way from its one end to the other.

As described above said reinforcing fibers f are carbon fibers. However, alternatively also other reinforcing fibers can be used. Especially, glass fibers are found to be suitable for elevator use, their advantage being that they are cheap and have good availability although a mediocre tensile stiffness and weight.

The rope storage solution presented in the application suits especially well for a composite rope as presented. However, the rope storage solution presented suits well also for other kinds of ropes having a straight form when in rest state and elastically bendable away from the straight form.

The feature that the rope is a rod having a straight form when in rest state and elastically bendable away from the straight form means that a 1.0 meter length of the straight rope 3,3',3",3'" straightens back without external forced, when released after a bending from straight form to a curved form, in which bending the rope 3,3',3",3'" is bent along its complete length to a curved form with a radius that is within the range of 0.3-0.5 meter. Thereby, the feature can be tested for example by bending the rope in this way.

The inner support drum d' can be provided with manually operable rotating means 26 for manually rotating the drum d'. Thus, the drum d' can be rotated for winding rope around the drum d'. This feature is advantageous when an old rope needs to be removed from the elevator during rope changing process. This feature enables winding the old rope around the drum d' manually. Accordingly, in the preferred embodiment of the method old rope is removed from elevator by winding it manually around a drum d' of said rope storage unit 1. The manual operation is facilitated by light-weighted structure of the rope 3,3',3",3'", which is realized particularly when the old rope is a composite material rope such as what is specified in this application elsewhere (rope 3,3',3",3'"). Said rotating means 26 preferably comprise a hole 26 that opens in axial direction x, for receiving a crank bar. The hole 26 is displaced from the central axis x of the rope reel, whereby torque can be produced in the drum d' for rotating it around the axis x. The hole 26 is in the preferred embodiment rectangular and thereby suitable for receiving a crank bar rectangular in cross-section. The bar meant here is preferably a wooden bar, such as one with standard size cross section of 2×4 inches.

Figure 13:
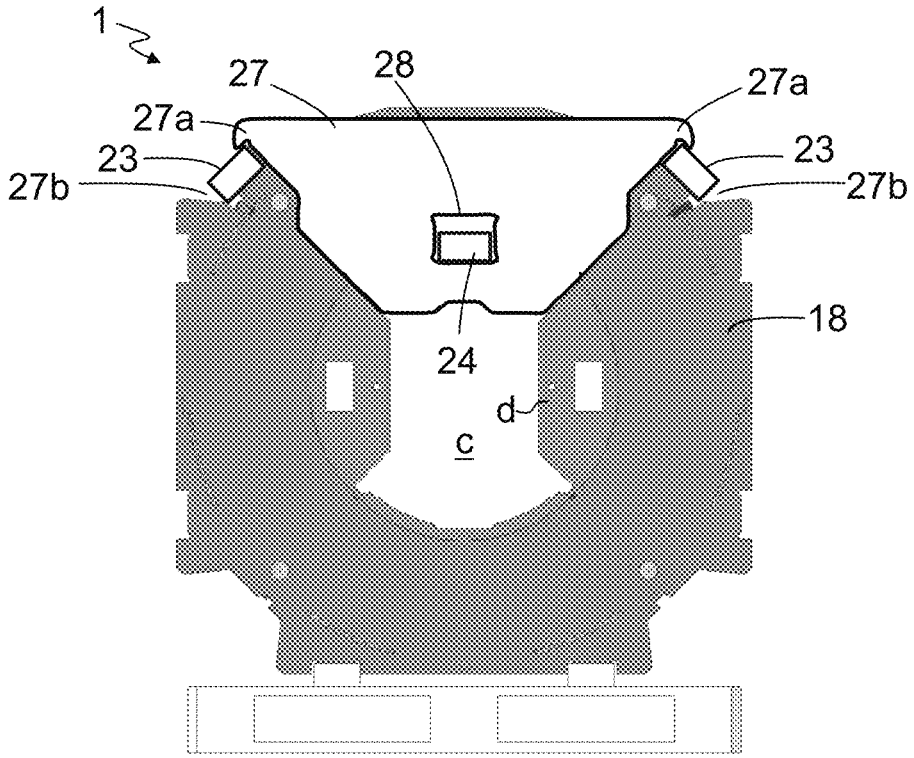
FIG. 13 illustrates an axial view of the rope storage unit when provided with a further support arrangement.
Figure 14:
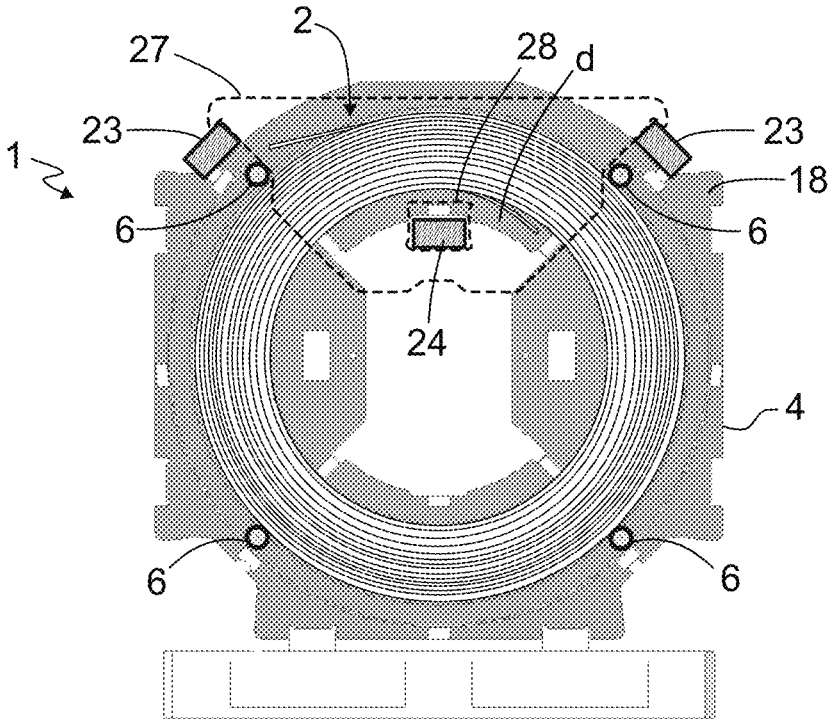
FIG. 14 illustrates a cross section of the rope storage unit of FIG. 13.

FIGS. 13 and 14 illustrate an embodiment of the rope storage unit 1 when provided with a further support arrangement 23,24,27,28. The further support arrangement 23,24,27,28 is arranged to carry at least part of the weight of the rope reel 2 from the inside. For this purpose, said further support arrangement 23,24,27,28 comprises a support member 24 extending inside the central space c of the rope reel 2. At least part of the weight of the rope reel 2 rests on the support member 24 extending inside the central space c of the rope reel 2.

The further support arrangement 23,24,27,28 is advantageous because when the rope storage unit 1 is delivered to an installation site by various kind of transportation methods, the rope storage unit 1 may face several liftings, drops and vibration. A problem occurs if the rope reel 2 where the rope is wound, lays on the rotatable support rollers 6 only. The further support arrangement 23,24,27,28 facilitates that the rotatable support rollers 6 and the side plates 18 are less likely to deform generally due to weight of the rope reel 2 or due to impacts or vibration caused in the delivery. The deformed parts or surfaces would cause non-rotation of the rope reel 2 during rope installation, which will lay dangers for the work. Also, if the inner reel is not secured, the impact from the drop down could damage the bottommost rollers 6 and the rolling surfaces.

The support member 24 supports the rope reel 2 preferably via components d and/or d' that are inside the central space of the rope reel 2, and rotate together with the rope reel 2 when this is rotated during unwinding. Further aspects of said components d,d' have been described elsewhere in the application.

Said support member 24 is supported on the side plates 18 of the support frame 4. For this purpose, the further support arrangement 23,24,27,28 comprises a support plate 27 mounted on each of the side plates 18, and the rope reel 2 extends between the support plates 27. Thus, the arrangement comprises a support plate 27 on both axial sides of the rope reel 2. The axial view of the rope storage unit 1 as presented in FIG. 13 can be similar from both axial directions.

The support member 24 is preferably an elongated bar, the bar preferably being a wooden bar, such as one with standard size cross section of 2×4 inches, for instance. The elongated bar 24 preferably extends through an opening 28 formed in each of said support plates 27. The elongated bar is elongated particularly in axial direction of the rope reel 2.

The further support arrangement 23,24,27,28 is preferably moreover such that it comprises a mounting means 23,27*a*, 27*b* for mounting the support plates 27 on the side plates 18, said mounting means preferably comprising one or more elongated bars 23 resting on the side plates 18, as it is the case in the embodiment of FIGS. 13 and 14. Each support plate 27 between which the rope reel 2 rests on the one or more elongated bars 23 comprises a portion 27*a*, such as a shoulder or shoulders as illustrated, extending over the bar 23. Via portions 27*a* the support plates 27 rest on the side plates 18. Each side plate 18 comprises seats 27*b* for receiving and supporting the elongated bars 23. In the presented embodiment, each said seat is in the form of a slot that has a surface on top of which an elongated bar 23 can be placed.

The preferred embodiment presented in FIGS. 13 and 14, is advantageous moreover for the reason that a three-point support is formed by the support arrangement 23,24,27,28. With the three-point support, tilting of the structures of the support arrangement 23,24,27,28 can be prevented. More specifically, each support plate 27 has two support points, where they are supported, and which two support points are at a horizontal distance from each other. One of said two support points is formed between one of the elongated bars 23 resting on the side plates 18, and the other of said support points is formed between the other of the elongated bars 23 resting on the side plates 18. A further support point is formed between the support member 24 and support plate 27, where the support member 24 is supported by the support plate 27. If follows that a three-point support is formed. Said further support point is preferably at a lower level than the aforementioned two support points, and between vertical lines drawn via said two support points, whereby balance and resistance against tilting can be facilitated.

Additional advantages that are possible to achieve with the support arrangement 23,24,27,28 of the preferred embodiment are that the support arrangement 23,24,27,28 is scalable to variable reel size, the support arrangement 23,24,27,28 can be used to lock the rotation of rope reel 2 during transportation, the support plates 27 protect the rope reel 2 from sideway wobbling during the delivery and the support plates 27, give sideway protection of the rope reel 2 if the reel falls down on its side.

Said further support arrangement 23,24,27,28 can be dismantled before unwinding the rope 3,3',3",3'" from the rope storage unit 1. This dismantling can be done by removing at least the support member 24.

The support arrangement 23,24,27,28 can be used in the method such that at least part of the weight of the rope reel 2 is carried by a further support arrangement 23,24,27,28 from the inside at least prior said unwinding. Preferably, at least part of the weight of the rope reel 2 is carried by the further support arrangement 23,24,27,28 from the inside during the transport of the rope storage unit 1, which transport precedes the aforementioned unwinding. Preferably, although not necessarily, in the method before unwinding the rope 3,3',3",3'" from the rope storage unit 1, the further support arrangement 23,24,27,28 is dismantled. The dismantling then preferably comprises shifting more of the weight of the rope reel 2 to be carried by one or more of the rotatable support rollers 6.

In the method, it is generally preferable that at least part of the weight of the rope reel 2 is carried by one or more of the rotatable support rollers 6 at least during said unwinding the rope 3,3',3",3'" from the rope storage unit 1. It is to be understood that the above description and the accompanying Figures are only intended to teach the best way known to the inventors to make and use the invention. It will be apparent to a person skilled in the art that the inventive concept can be implemented in various ways. The above-described embodiments of the invention may thus be modified or varied, without departing from the invention, as appreciated by those skilled in the art in light of the above teachings. It is therefore to be understood that the invention and its embodiments are not limited to the examples described above but may vary within the scope of the claims and their equivalents.

The invention claimed is:

1. A rope storage unit for storing an elevator rope during transport and/or installation of the elevator rope, the rope storage unit comprising:

a rope reel, formed by a rope wound in a spiral form and having a central axis; and a support frame provided with an inner space inside which the rope reel is positioned supported by the support frame such that it can in use be rotated in the inner space for unwinding the rope, wherein the rope is a rod having a straight form when in rest state and elastically bendable away from the straight form, the rope being under substantial bending tension in said spiral form, and wherein the support frame comprises three or more rotatable support rollers delimiting said inner space and surrounding radially said rope reel.

2. The rope storage unit according to claim 1, wherein said rotatable support rollers are suitable for supporting the rim of the rope reel from the outside and rolling against the rim of the rope wheel when the rope reel rotates in the inner space.

3. The rope storage unit according to claim 1, wherein the outer rim of the rope reel radially compresses against said support rollers as an effect of said bending tension and said rotatable support rollers block the radius thereof from expanding.

4. The rope storage unit according to claim 1, wherein each of said rotatable support rollers has a central axis around which each of said rotatable support rollers is rotatable, the central axis extending through the rotatable support roller and being aligned parallel with the central axis of the rope reel.

5. The rope storage unit according to claim 1, wherein the rotatable support rollers are positioned such that central axes thereof are positioned at corners of a polygon and the central axis of the rope reel is within the polygon.

6. The rope storage unit according to claim 1, wherein each of the three or more rotatable support rollers is mounted at a fixed location on the support frame.

7. The rope storage unit according to claim 1, wherein the support frame comprises two side plates, which are on opposite sides of the rope reel in an axial direction of the rope reel, and wherein the side plates delimit the inner space in the axial direction of the rope reel.

8. The rope storage unit according to claim 7, wherein said support rollers are mounted on the side plates.

9. The rope storage unit according to claim 1, wherein said rope comprises one or more load bearing members extending parallel with the longitudinal direction of the rope unbroken throughout the length of the rope, the one or more load bearing members being made of composite material comprising reinforcing fibers in polymer matrix.

10. The rope storage unit according to claim 1, wherein the rope reel has an end section of said rope placed against or protruding from the outer rim of the rope reel, and the rope is unwindable by rotating or allowing rotation of the rope reel in the inner space and guiding said end section away from the rope reel.

11. The rope storage unit according to claim 1, wherein the rope is wound in a spiral form with several rope rounds, including at least a radially outermost rope round, the rope being unwindable rope round by rope round starting from the outermost rope round.

12. The rope storage unit according to claim 1, wherein the rope storage unit comprises a further support arrangement for carrying at least part of the weight of the rope reel from the inside.

13. The rope storage unit according to claim 1, wherein said further support arrangement comprises a support member extending inside the central space of the rope reel.

14. A method for installing an elevator rope, comprising the steps of:

providing the rope storage unit according to claim 1;

unwinding the rope from the rope storage unit; and connecting the rope to one or more movable elevator units, said units including at least an elevator car and a counterweight.

15. The method according to claim 14, wherein the rope is wound in a spiral form with several rope rounds, including at least a radially outermost rope round, and a radially innermost rope round, and in said unwinding the rope is unwound rope round by rope round starting from the outermost rope round.

16. The method according to claim 14, wherein said unwinding comprises rotating or allowing rotation of the rope reel in the inner space such that said rotatable support rollers support the rim of the rope reel from the outside, and roll against the rim of the rope reel.

17. The method according to claim 14, wherein the rope wound in a spiral form has an end section placed against or protruding from the outer rim of the rope reel, and said unwinding comprises rotating or allowing rotation of the rope reel in the inner space and guiding said end away from the rope reel.

18. The method according to claim 14, wherein at least part of the weight of the rope reel is carried by one or more of the rotatable support rollers at least during said unwinding the rope from the rope storage unit.

19. The method according to claim 14, wherein at least part of the weight of the rope reel is carried at least prior said unwinding the rope from the rope storage unit by a further support arrangement from the inside.

20. The method according to claim 19, wherein before said unwinding the rope from the rope storage unit, the further support arrangement is dismantled.

* * * * *